US008579578B2

(12) United States Patent
Pan

(10) Patent No.: US 8,579,578 B2
(45) Date of Patent: Nov. 12, 2013

(54) FAN BIASING TRANSMISSION MECHANISM

(75) Inventor: Jye-Liang Pan, Taipei (TW)

(73) Assignee: Ching Lang TSAI, Taichung (TW)

( * ) Notice: Subject to any disclaimer, the term of this patent is extended or adjusted under 35 U.S.C. 154(b) by 523 days.

(21) Appl. No.: 12/969,816

(22) Filed: Dec. 16, 2010

(65) Prior Publication Data

US 2012/0156040 A1 Jun. 21, 2012

(51) Int. Cl.
*F01D 25/00* (2006.01)

(52) U.S. Cl.
USPC ..... 415/124.1; 416/100; 416/170 R

(58) Field of Classification Search
USPC ..... 415/122.1, 124.1, 125; 416/100, 108, 416/170 R
See application file for complete search history.

(56) References Cited

U.S. PATENT DOCUMENTS

| | | | | |
|---|---|---|---|---|
| 1,676,467 | A * | 7/1928 | Stuart | 74/42 |
| 2,900,127 | A * | 8/1959 | Smith | 417/423.15 |
| 3,625,633 | A * | 12/1971 | Nelson | 416/169 R |
| 6,015,262 | A * | 1/2000 | Huang | 416/100 |
| 6,682,305 | B1 * | 1/2004 | Lim | 416/170 R |
| 7,811,059 | B2 * | 10/2010 | Sagucio | 416/100 |

* cited by examiner

*Primary Examiner* — Edward Look
*Assistant Examiner* — Liam McDowell
(74) *Attorney, Agent, or Firm* — Muncy, Geissler, Olds & Lowe, PLLC

(57) ABSTRACT

A fan biasing transmission mechanism includes gearbox affixed to the rear side of the housing of an electric fan's fan motor, a control rod pivotally and axially movably mounted in the gearbox. a power gear fixedly mounted on the control rod and meshed with a motor shaft worm wheel of the fan motor, a driving gear pivotally mounted in the gearbox, a gear-clutch gear fixedly mounted on the control rod and movable with the control rod into mesh with the gear-clutch gear, a first bevel gear fixedly mounted on the driving gear, a second bevel gear meshed with the first bevel gear, a bracket, a crank arm pivotally coupled between the gear shaft and the bracket, and an elastic member connected between the gear shaft and the gearbox.

1 Claim, 4 Drawing Sheets

FAN BIASING TRANSMISSION MECHANISM

BACKGROUND OF THE INVENTION

1. Field of the Invention

The present invention relates to electric fans and more particularly, to a fan biasing transmission mechanism, which can be controlled for enabling the fan body to be biased alternatively forwards and backwards (upwards and downwards) during its 360° rotation.

2. Description of the Related Art

There are commercial electric fans that allow biasing of the fan body during its 360° rotation. In these prior art designs, the mechanism which enables the fan body to be biased during rotation of the fan motor is mounted inside the motor housing. This arrangement has drawbacks: 1. Big size housing; 2. Complicated structure and high cost; 3. Installation and maintenance inconvenience; 4. Being suitable for use in a ceiling fan but not practical for use in a floor fan.

SUMMARY OF THE INVENTION

The present invention has been accomplished under the circumstances in view. It is one object of the present invention to provide a fan biasing transmission mechanism, which can be controlled for enabling the fan body to be biased alternatively forwards and backwards (upwards and downwards) during 360° rotation of the fan motor.

To achieve this and other objects of the present invention, a fan biasing transmission mechanism comprises gearbox affixed to the rear side of the housing of an electric fan's fan motor, a control rod pivotally and axially movably mounted in the gearbox. a power gear fixedly mounted on the control rod and meshed with a motor shaft worm wheel of the fan motor, a driving gear pivotally mounted in the gearbox, a gear-clutch gear fixedly mounted on the control rod and movable with the control rod into mesh with the gear-clutch gear, a first bevel gear fixedly mounted on the driving gear, a second bevel gear meshed with the first bevel gear, a bracket, a crank arm pivotally coupled between the gear shaft and the bracket, and an elastic member connected between the gear shaft and the gearbox.

DETAILED DESCRIPTION OF THE PREFERRED EMBODIMENT

Figure 1:
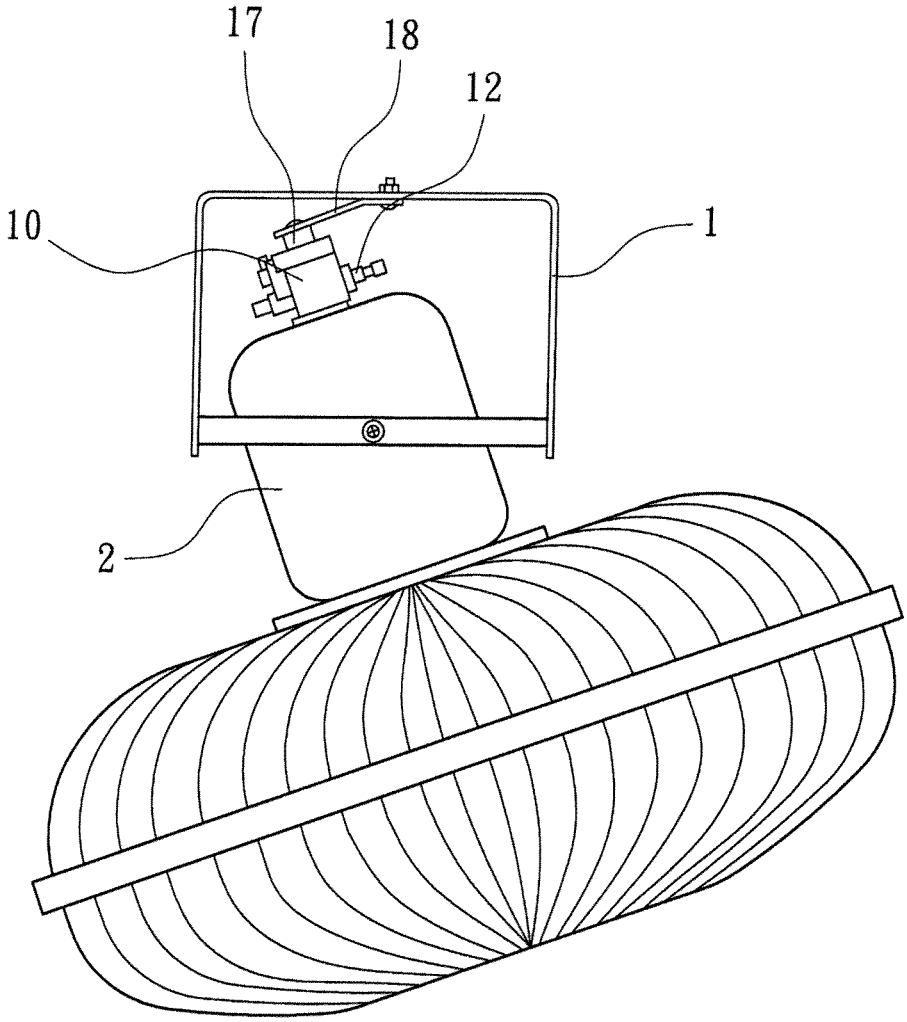
FIG. 1 is a schematic drawing illustrating a fan biasing transmission mechanism installed in an electric fan in accordance with the present invention.
Figure 2:
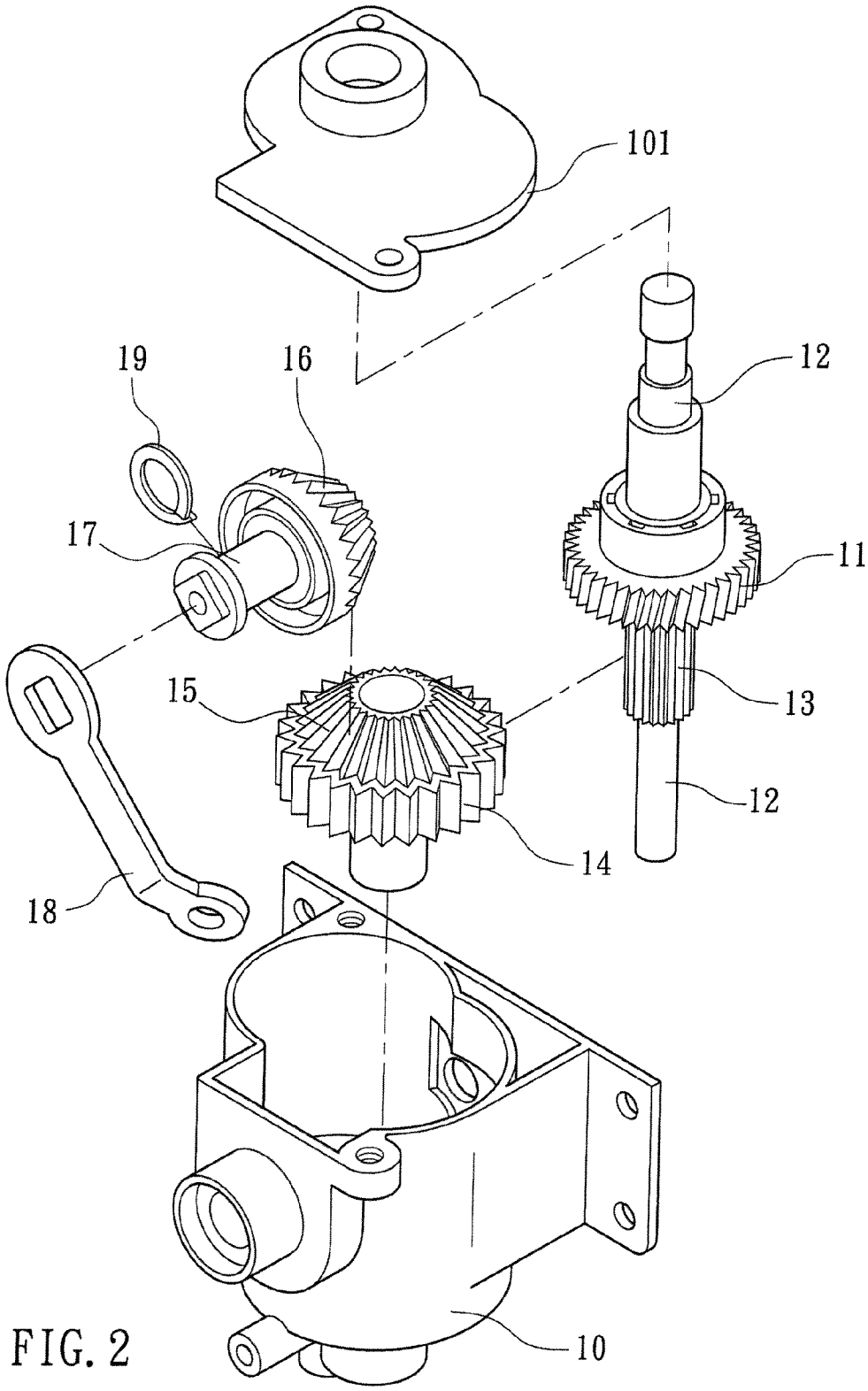
FIG. 2 is an exploded view of the fan biasing transmission mechanism in accordance with the present invention.

Referring to FIGS. 1~5, a fan biasing transmission mechanism in accordance with the present invention is shown comprising a gearbox 10 affixed to the rear side of the housing of an electric fan's fan motor 2, a control rod 12 pivotally and axially movably mounted in the gearbox 10, a power gear 11 fixedly mounted on the control rod 12 and meshed with a motor shaft worm wheel 3 of the fan motor 2 for synchronous rotation with the fan motor 2, a driving gear 14 pivotally mounted in the gearbox 10, a gear-clutch gear 13 fixedly mounted on the control rod 12 and movable with the control rod 12 into mesh with the driving gear 14, a first bevel gear 15 fixedly mounted on the driving gear 14, a second bevel gear 16 meshed with the first bevel gear 15 and having a gear shaft 17, a crank arm 18 pivotally coupled between the gear shaft 17 and a bracket 1, an elastic member 19 connected between the gear shaft 17 and the gearbox 10 to enhance engagement between the first bevel gear 15 and the second bevel gear 16, and a cover 101 covering the gearbox 10.

Figure 3:
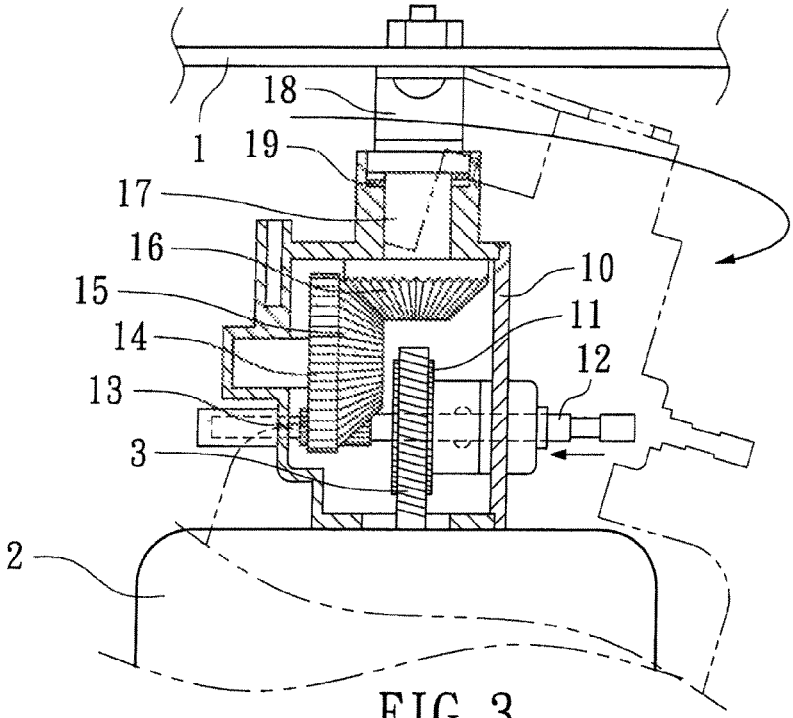
FIG. 3 is a sectional assembly view of the fan biasing transmission mechanism in accordance with the present invention.
Figure 4:
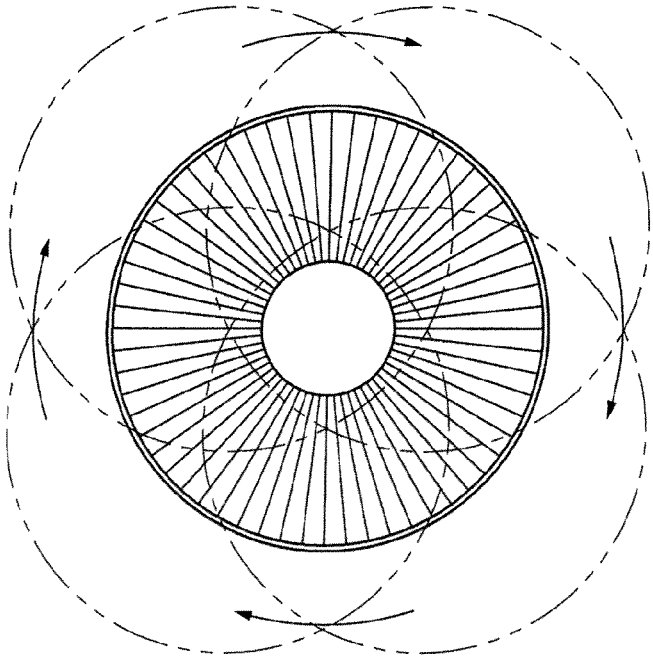
FIG. 4 illustrates a first operation mode of the present invention where the electric fan is biased during 360° rotation of the fan motor.

According to the example shown in FIG. 1, the electric fan is a ceiling fan where the bracket 1 is to be affixed to the ceiling. When the control rod 12 is moved into the "engaged" position, as shown in FIG. 3, the gear-clutch gear 13 is forced into mesh with the driving gear 14. Thus, during rotation of the motor shaft worm wheel 3 of the fan motor 2 (i.e., during operation of the electric fan), the driving gear 14 is rotated with the gear-clutch gear 13 to rotate the driving gear 14 and the first bevel gear 15, causing rotation of the second bevel gear 16, and therefore the crank arm 18 is rotated to bias the housing of the fan motor 2 alternatively forwards and backwards (upwards and downwards) during 360° rotation of the fan motor 2 (see FIG. 4).

Figure 5:
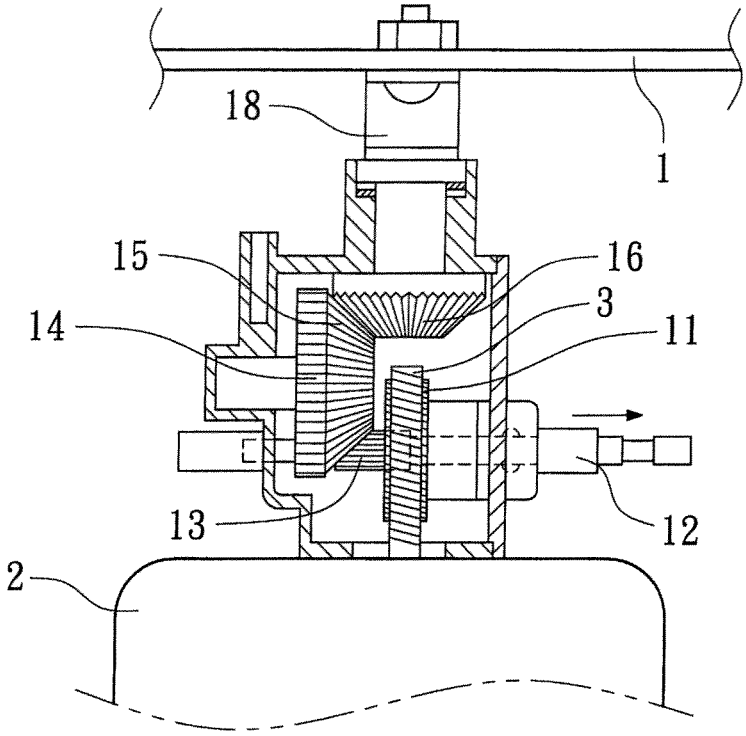
FIG. 5 illustrates a second operation mode of the present invention where the electric fan is kept immovable during 360° rotation of the fan motor.

Referring to FIG. 5, when the control rod 12 is pulled away from the "engaged" position to the "disengaged" position, the gear-clutch gear 13 is moved away from the driving gear 14. Thus, during rotation of the motor shaft worm wheel 3 of the fan motor 2 (i.e., during operation of the electric fan), the driving gear 14 is not rotated with the gear-clutch gear 13, and therefore the fan motor 2 is constantly rotating on its own axis.

Figure 6:
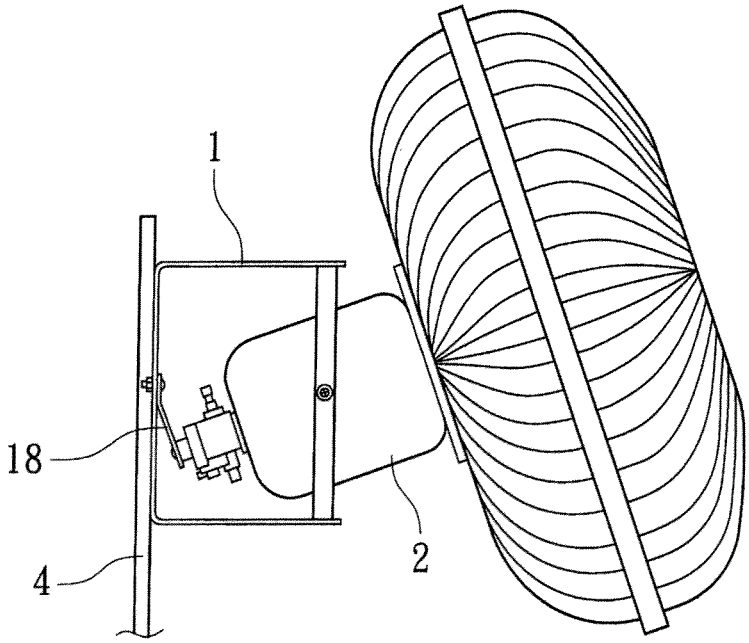
FIG. 6 illustrates the fan biasing transmission mechanism used in a floor fan in accordance with the present invention.

Further, according to the example shown in FIG. 6, the electric fan is a floor fan where the bracket 1 is to be affixed to the stand 4 of the electric fan.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A fan biasing transmission mechanism, comprising:

a gearbox affixed to a rear side of a housing of a fan motor of an electric fan;

a control rod pivotally and axially movably mounted in said gearbox;

a power gear fixedly mounted on said control rod and meshed with a motor shaft worm wheel of said fan motor for synchronous rotation with said fan motor;

a driving gear pivotally mounted in said gearbox;

a gear-clutch gear fixedly mounted on said control rod and movable with said control rod between a first position where said gear-clutch gear is meshed with said driving gear and a second position where said gear-clutch gear is separated from said driving gear;

a first bevel gear fixedly mounted on said driving gear;

a second bevel gear meshed with said first bevel gear, said second bevel gear having a gear shaft;

a bracket;

a crank arm pivotally coupled between said gear shaft and said bracket;

an elastic member connected between said gear shaft and said gearbox; and a cover covering said gearbox.

* * * * *